US005278473A

United States Patent [19]

Parks, Jr. et al.

[11] Patent Number: 5,278,473

[45] Date of Patent: Jan. 11, 1994

[54] METHOD OF DESPENSING MERCURY INTO ARC DISHCHARGE LAMP HAVING CAPSULE COATED WITH LOW IONIZATION ENERGY MATERIAL

[75] Inventors: Ralph P. Parks, Jr.; Kendrick D. Rattray, both of Danvers; Dennis D. Spaulding, Andover, all of Mass.

[73] Assignee: GTE Products Corporation, Danvers, Mass.

[21] Appl. No.: 48,554

[22] Filed: Apr. 15, 1993

Related U.S. Application Data

[63] Continuation of Ser. No. 509,440, Apr. 16, 1990, abandoned.

[51] Int. Cl.[5] ..... H01J 61/18

[52] U.S. Cl. ..... 313/546; 313/566; 445/9

[58] Field of Search ..... 313/564, 565, 566, 546; 445/9-

[56] References Cited

U.S. PATENT DOCUMENTS 4,870,323 9/1989 Park, Jr. et al. ..... 313/565

*Primary Examiner*—Sandra L. O'Shea

*Attorney, Agent, or Firm*—Carlo S. Bessone

[57] ABSTRACT

A method of dispensing mercury into an arc discharge lamp containing a mercury capsule adjacent one of the coil electrodes is disclosed. The method includes the step of preparing a solution of a low ionization energy material and coating at least a portion of the mercury capsule. Thereafter, the mercury dispensing capsule is bombarded with a directed stream of electrons produced by the other coil electrode of sufficient energy to rupture the capsule causing the mercury to be released. The coating focuses the directed stream of electrons directly on the capsule, thereby reducing the amount of time necessary to rupture the capsule.

12 Claims, 1 Drawing Sheet

METHOD OF DESPENSING MERCURY INTO ARC DISHCHARGE LAMP HAVING CAPSULE COATED WITH LOW IONIZATION ENERGY MATERIAL

This application is a continuation of copending application Ser. No. 07/509,440, filed on Apr. 16, 1990, now abandoned.

TECHNICAL FIELD

This invention relates to low pressure arc discharge lamps, particularly fluorescent lamps, which contain mercury. It is especially concerned with the method by which the mercury is introduced into such lamps.

BACKGROUND OF THE INVENTION

Fluorescent lamps are well-known in the art and are used for a variety of types of lighting installations. Such lamps are characterized as low pressure discharge lamps and include an elongated envelope, whose interior surface is coated with a layer of phosphor, and an electrode at each end of the envelope. The envelope also contains a quantity of an ionizable medium such as mercury, and a starting gas at a low pressure, generally in the range of 1 to 5 mm Hg. The starting gas may consist of argon, neon, helium, krypton or a combination thereof.

One of the most commonly used methods for introducing mercury into such lamps is a mechanical dispensing unit which forms part of a so-called exhaust machine. Mercury is dispensed by the action of a slotted plunger passing through a reservoir of mercury and into the closed exhaust chamber housing the exhaust tube. The mercury falls through the exhaust tube into the lamp. This method of dispensing mercury has many drawbacks. In the first place, the mercury dispensing unit complicates the exhaust machine. In the second place, the amount of mercury introduced into the lamp envelope by this method can not be precisely controlled.

The lamp during processing is at a high temperature and is in open communication with the exhaust machine. As a result, it is inevitable that a portion of the introduced mercury evaporates and disappears from the lamp, or a portion of the filling gas is driven out of the lamp. Furthermore, the introduction of mercury through the exhaust tube involves the risk of mercury getting stuck in the exhaust tube so that after lamp sealing, the lamp contains too little or no mercury at all. For these reasons a large excess of mercury, namely a multiple of the quantity required by the lamp is generally introduced. Finally, working with mercury on the exhaust machine requires additional safety precautions on medical grounds.

An alternative method of dispensing mercury is to place inside the lamp a mercury compound that is inert under lamp processing conditions but can later be activated to release mercury. Disadvantageously, this method releases impurities, which then require special gettering. Moreover, this method requires a relatively long period of time to activate the mercury compound (e.g., 20 to 30 seconds). As a result, this method of dispensing mercury does not readily lend itself to high speed production machinery.

Another method of introducing mercury into an arc discharge lamp is set forth in U.S. Pat. No. 4,553,067 which issued to Roche et al on Nov. 12, 1985 and is assigned to the same Assignee as the present Application. Therein a mercury dispensing target is located within an exhausted lamp having a coil at each end of the lamp. The dispensing target is affixed to a lead-in wire adjacent one of the coils. During processing, the mercury target is heated by bombarding the target with a directed stream of electrons produced by one of the coils which causes the contained mercury to be released. Although this method reduces mercury release time to 3.5 seconds, it is desirable to obtain further reductions.

U.S. Pat. No. 4,870,323, which issued to Parks, Jr. et al on Sept. 26, 1989 and is assigned to the same Assignee as the present Application, describes a method of dispensing mercury into a fluorescent lamp wherein portions of the mount structure are coated with an insulating coating (e.g., zirconium dioxide) to decrease the time needed to release mercury from a capsule within the lamp. A directed stream of electrons is focused to a portion of the mercury dispensing capsule devoid of the insulating coating. Although this method is effective in reducing the mercury release time, the application of an insulating coating to the various portions of the mount structure may be impractical in commercial production.

SUMMARY OF THE INVENTION

It is, therefore, an object of the invention to obviate the disadvantages of the prior art.

It is another object of the invention to enhance the dispensing of mercury into an arc discharge lamp.

It is still another object of the invention to reduce the amount of time required to release mercury into an arc discharge lamp without the use of insulating coatings.

It is still another object of the invention to provide a method of dispensing mercury into a lamp in a manner which lends itself to high speed production machinery.

These objects are accomplished, in one aspect of the invention, by the provision of an arc discharge lamp having an envelope of light-transmitting vitreous material having opposing end portions and containing an inert starting gas. The lamp further includes first and second coil electrodes respectively located within the opposing end portions. First and second pairs of lead-in wires respectively connect the first and second electrodes. A mercury dispensing capsule is adjacent the first coil electrode and is electrically connected to one of the first pair of lead-in wires. A low ionization energy material is disposed over at least a portion of the mercury dispensing capsule.

It has been discovered that during the mercury releasing process, the low ionization energy material on the capsule effectively attracts electrons to the main body portion of the mercury capsule (i.e., the portion containing the mercury). As a result, the time needed to release mercury into the lamp is significantly reduced.

In accordance with further aspects of the present invention, the low ionization energy material is selected from the group consisting of cesium carbonate or sodium chloride.

In accordance with the teachings of the invention, the low ionization energy material is disposed on substantially the entire outer surface of the mercury dispensing capsule. Alternatively, the material is disposed solely on the outer surface of substantially the entire main body portion of the capsule or merely on the outer surface of the remote end of the capsule.

In accordance with another aspect of the present invention, there is defined a method of releasing mercury into an arc discharge lamp. The method includes the steps of preparing a solution of a low ionization energy material and coating a portion of the mercury dispensing capsule with the solution. The solution is dried such that the low ionization material remains on the selected portion of the mercury capsule. The mercury dispensing capsule is bombarded with a directed stream of electrons of sufficient energy to heat the capsule and release mercury into the lamp.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
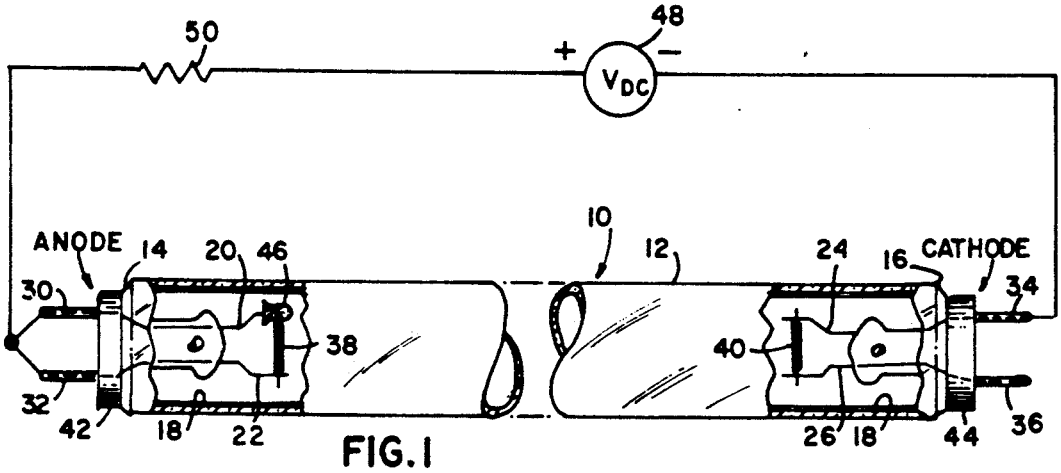
FIG. 1 partly broken away, perspective view of an arc discharge lamp electrically connected to a circuit employable in releasing mercury according to the invention.
Figure 2:
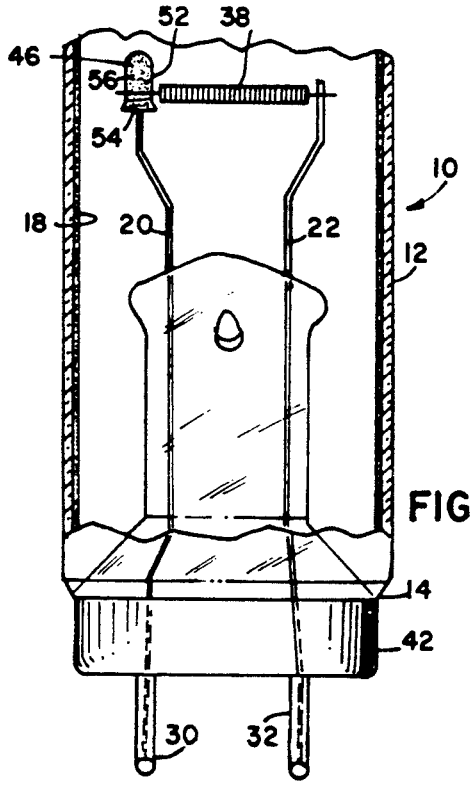
FIG. 2 is an enlarged, perspective view of a portion of the arc discharged lamp in FIG. 1.

Referring now to the drawings with greater particularity, there is shown in FIGS. 1 and 2 an arc discharge lamp 10 (e.g., a fluorescent lamp) having a sealed envelope 12 of light-transmitting vitreous material. Envelope 12 has opposing end portions 14, 16, and encloses an inert starting gas. The starting gas may consist of argon, neon, helium, krypton or a combination thereof at a low pressure in the range of about 1 to 5 mm Hg.

A first coil electrode 38 and a second coil electrode 40 are located within opposing end portions 14 and 16, respectively. Electrodes 38, 40 are coated with electron-emitting materials such as BaO—SrO—CaO containing $MZrO_3$. A first pair of lead-in wires 20, 22 connects first electrode 38 and a second pair of lead-in wires 24, 26 connect second electrode 40. Suitable bases 42, 44 carrying contacts 30, 32 and 34, 36 are respectively sealed adjacent end portions 14, 16. Lead-in wires 20, 22 and 24, 26 are electrically connected to contacts 30, 32 and 34, 36, respectively.

A phosphor coating 18 is disposed on the interior surface of envelope 12. Phosphor coating 18 is responsive to the ultraviolet radiation generated by the plasma discharge to provide the desired emission spectrum.

As further shown in FIGS. 1 and 2, arc discharge lamp 10 contains a mercury dispensing target such as a metal capsule 46 electrically connected to lead-in wire 20 adjacent first electrode 38. Mercury capsule 46 extends from lead-in wire 20 and electrically forms a part thereof by being spot welded to the lead-in wire. As best illustrated in FIG. 2, main body portion 52 of capsule 46 extends above the plane of coil 38 toward the center of lamp 10 so as to be a direct target for electron bombardment.

Mercury capsule 46 has a tubular-shaped main body portion 52 which encloses a quantity of mercury prior to processing. The mercury is sealed within the main body portion of the capsule by means of a flattened end portion 54. The mercury may be sealed within the capsule, for example, by utilizing the teachings of U.S Pat. No. 4,754,193, issued on Jun. 28, 1988 and assigned to the same Assignee as the present Application.

In accordance with the teachings of the present invention, a coating 56 is disposed over at least a portion of metal capsule 46. Coating 56 consists of a chemical material having a low ionization energy level. A low ionization energy material is a material composed of at least one element having an ionization potential of approximate equivalence or below that of barium, where the ionization potential of barium is 5.212 eV. Examples of suitable materials for coating 56 are cesium carbonate and sodium chloride.

Figure 3:
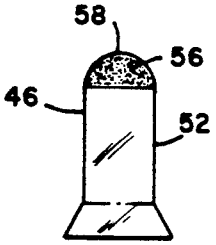
FIGS. 3 and 4 are enlarged, perspective views of alternative embodiments of the invention.
Figure 4:
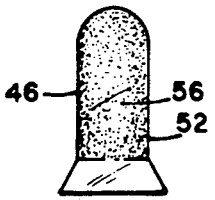

The chemical compound can be deposited in solution form on various portions of the capsule. For example, as illustrated in FIGS. 1 and 2, coating 56 is deposited on substantially the entire outer surface of capsule 46. Alternatively, only the outer surface of the remote end or nose portion 58 of capsule 46 (FIG. 3) or only the outer surface of the main body portion 52 (FIG. 4) are coated with the material.

The basic circuit arrangement for utilizing electron current to release the mercury is shown in FIG. 1 as comprising a d.c. power supply 48 and a current-limiting resistor 50. The end of lamp 10 containing the mount to which mercury capsule 46 is attached is connected to the positive side of power supply 48 . Contact 34 of base 44 located at the other end of lamp 10 is connected to the negative side of power supply 48.

The current drawn through fluorescent lamp 10 during the capsule rupturing process is essentially electron current. The primary source of electron current within lamp 10 is the lamp cathode which in the d.c. circuit is the electrode 40 connected to the negative side of the power supply 48. The primary electron current generates secondary electrons through an ionization process in the positive column of the evacuated, filled and sealed lamp. These electrons have a random thermal velocity as well as a drift velocity established by the lamp field in the direction from cathode-to-anode. Electrons arriving at the positive end (i.e., anode) of the lamp will normally be collected by electrode 38, lead-in wires 20, 22, and mercury capsule 46.

The distribution of electrons arriving at the anode is initially random, however, it has been discovered that as the temperature of the outer capsule surface increases, the coating on the surface of the capsule evaporates into the gas surrounding the capsule. Once the material evaporates, it readily ionizes creating a more favorable path for electron flow. There is no longer a random distribution of electron collection by the anode affected only by the fact that the capsule is above the plane of the coil, but now the electrons are more readily collected by the capsule itself as opposed to the coil and clamps. The rate at which the capsule temperature increases is proportional to the amount of electrons that are being collected. And since the capsule]rupture is caused by the increase in capsule temperature, which vaporizes the mercury inside the capsule, it is evident that the faster the capsule heats up, the lower the average rupture time will be.

Although the rupture circuit illustrated in FIG. 1 uses direct current, the lamp is generally intended for use on an alternating current circuit.

It has been discovered that by coating at least a portion of the outer surface of the mercury capsule with low ionization energy material according to the present invention, the amount of time needed to release mercury can be significantly reduced. The coating focuses the electrons during rupture of the capsule on the capsule itself.

In a typical but non-limitative example, mercury capsule 46 is formed from a generally tubular metal cup 80 made from Alloy 4 and having a smaller diameter tubular portion of 0.060 inch (1.52 millimeters) outer diameter (O.D.), a wall thickness of approximately 0.0030 inch (0.076 millimeter) and a length L of 0.400 inch (1.016 centimeters). Approximately 16 milligrams of mercury is dispensed into the capsule through an open end. A sealed end portion is formed by crimping the end portion of the capsule. The formed mercury capsule is secured to one of the lead-in wires adjacent one of the electrodes in an F40T12/CW/SS fluorescent lamp as shown in FIGS. 1 and 2. A solution of cesium carbonate and distilled water having concentrations as described in TABLE 1 is applied to the remote end or nose portion of the mercury capsule. The applied solution is air dried to leave a coating of cesium carbonate.

After evacuating and sealing the lamps, the mercury in each capsule is released by heating the capsules to an elevated temperature sufficient to cause capsule rupture by using the apparatus illustrated in FIG. 1. A suitable activation current was 1 amp DC.

TABLE I below shows the resulting mercury release times of various groups of test lamps similar to those described in the above example. Control lamps were manufactured in a similar manner except for the lack of the low ionization energy material on the capsule.

TABLE I

| | Avg. release time (delta %) |
|---|---|
| 1% $CsCO_3$ (0.14 g $CsCO_3$ & 70 ml $H_2O$) | 1.65 (−15.0) |
| 10% $CsCO_3$ (0.14 g $CsCO_3$ & 7.0 ml $H_2O$) | 1.20 (−40.0) |
| 50% $CsCO_3$ (0.14 g $CsCO_3$ & 1.4 ml $H_2O$) | 1.50 (−25.0) |
| 100% $CsCO_3$ (0.28 g $CsCO_3$ & 1.4 ml $H_2O$) | 1.50 (−25.0) |
| controls (no $CsCO_3$ coating) | 2.00 |

The use of the coating of cesium carbonate on the mercury capsule resulted in from 15.0 to 40.0 percent decrease in mercury release time.

There has thus been shown and described a method of releasing mercury into an arc discharge lamp which reduces the amount of time needed to dispense the mercury. Because of the relatively short release times, the method lends itself to high speed production machinery.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. In an arc discharge lamp having an envelope of light-transmitting vitreous material having opposing end portions and containing an inert starting gas, first and second coil electrodes respectively located within said opposing end portions, portions of said first and second electrodes having an emissive material thereon, first and second pairs of lead-in wires respectively connecting said first and second electrodes, a mercury dispensing capsule adjacent said first coil electrode electrically connected to an extending from one of said first pair of lead-in wires, said mercy dispensing capsule defining a main body portion having a remote end, the improvement comprising:

a coating of low ionization energy material disposed over a portion of said mercy dispensing capsule, said material being composed of at least one element having an ionization potential of approximate equivalence or below 5.212 eV.

2. The improvement according to claim 1 wherein said low ionization energy material is selected from the group consisting of cesium carbonate and sodium chloride.

3. The improvement according to claim 1 wherein said coating is disposed on substantially the entire outer surface of said mercury dispensing capsule.

4. The improvement according to claim 1 wherein said coating is disposed solely on the outer surface of said main body portion of the mercury dispensing capsule.

5. The improvement according to claim 1 wherein said coating is disposed solely on the outer surface of said remote end of said main body portion of the mercury dispensing capsule.

6. The method of releasing mercury into an arc discharge lamp having an envelope having opposing end portions and containing an inert starting gas, first and second coil electrodes respectively located within said opposing end portions, first and second pairs of lead-in wires respectively connecting said first and second electrodes, a mercury dispensing capsule adjacent said first coil electrode electrically connected to and extending from one of said first pair of lead-in wires, said mercury dispensing capsule defining a main body portion having a remote end, the method comprising the steps of:

preparing a solution of a low ionization energy material, said material being composed of at least one element having an ionization potential of approximate equivalence or below 5.212 eV;

coating a portion of said mercury dispensing capsule with said solution;

drying said solution such that said low ionization material remains on said portion of said mercury capsule; and bombarding said mercury dispensing capsule with a directed stream of electrons of sufficient energy to heat said capsule and release mercury.

7. The improvement according to claim 6 wherein said coating of low ionization energy material is selected from the group consisting of cesium carbonate and sodium chloride.

8. The improvement according to claim 6 wherein said method includes the step of disposing said coating on substantially the entire outer surface of said mercury dispensing capsule.

9. The improvement according to claim 6 wherein said method includes the step of disposing said coating solely on the outer surface of said main body portion of the mercury dispensing capsule.

10. The improvement according to claim 6 wherein method includes the step of disposing said coating solely on the outer surface of said remote end of said main body portion of the mercury dispensing capsule.

11. The improvement according to claim 6 wherein said step of preparing a solution further includes mixing said material in a predetermined amount of distilled water.

12. The improvement according to claim 11 wherein said step of drying said solution includes evaporating said distilled water.

* * * * *